United States Patent [19]

Tanahashi et al.

[11] Patent Number: 5,004,172

[45] Date of Patent: Apr. 2, 1991

[54] TAKE-UP APPARATUS FOR AMORPHOUS METAL RIBBON

[75] Inventors: Masaaki Tanahashi; Hiroyuki Hagiwara, both of Kumagaya; Hiroyuki Fujii, Kounosu, all of Japan

[73] Assignee: Hitachi Metals Ltd., Tokyo, Japan

[21] Appl. No.: 369,410

[22] Filed: Jun. 21, 1989

[30] Foreign Application Priority Data

Feb. 17, 1989 [JP] Japan ..... 1-37694

[51] Int. Cl.[5] ..... B65H 20/14; B65H 18/00

[52] U.S. Cl. ..... 242/54 R; 242/78.3; 242/74; 226/97

[58] Field of Search ..... 242/56 R, 75.51, 75.52, 242/25 R, 25 A, 45, 74, 78.3, 78.8, 56 R, 56 A, 182, 183, 184, 185; 226/91, 95, 97

[56] References Cited

U.S. PATENT DOCUMENTS

| | | | |
|---|---|---|---|
| 3,156,423 | 11/1964 | Potter et al. | 242/185 |
| 3,189,291 | 6/1965 | Welsh | 242/185 X |
| 3,586,258 | 6/1971 | Horlezeder | 242/74 X |
| 3,648,950 | 3/1972 | Grabl | 242/75.51 X |
| 3,908,920 | 9/1975 | Hermanns | 242/45 |
| 3,938,583 | 2/1976 | Kavish . | |
| 4,116,394 | 9/1978 | Smith et al. | 242/25 R |
| 4,133,495 | 1/1979 | Dowd | 242/74 X |
| 4,669,679 | 6/1987 | Pali | 242/25 A |
| 4,787,571 | 11/1988 | Kosugi et al. | 226/97 X |

FOREIGN PATENT DOCUMENTS

| | | |
|---|---|---|
| 53-24961 | 3/1978 | Japan . |
| 115555 | 9/1980 | Japan . |
| 56-99054 | 8/1981 | Japan . |
| 60-246612 | 12/1985 | Japan . |
| 61-82953 | 4/1986 | Japan . |
| 127145 | 6/1987 | Japan . |
| 151251 | 7/1987 | Japan . |

*Primary Examiner*—John M. Jillions

*Attorney, Agent, or Firm*—Sughrue, Mion, Zinn, Macpeak & Seas

[57] ABSTRACT

In a take-up apparatus for an amorphous metal ribbon a first tubular guide provides a passage for the ribbon from a ribbon manufacturing apparatus. A storage chamber is connected to the first tubular guide and a take-up drum is connected to the storage chamber through a second telescopic tubular guide. A gas suction device is connected to the take-up drum through a third tubular guide. The take-up apparatus is arranged in tandem with the ribbon manufacturing apparatus which comprises a crucible equipped at its lower end with a nozzle and accommodating a molten metal therewithin and a rapidly rotating quench roll disposed below the nozzle. The ribbon is manufactured by rapidly quenching the molten metal ejected from the nozzle on the quench roll and removing the ribbon at a high speed in a direction tangent to the quench roll. The ribbon is then sucked into the first tubular guide together with an air flow provided by the gas suction device.

17 Claims, 5 Drawing Sheets

TAKE-UP APPARATUS FOR AMORPHOUS METAL RIBBON

BACKGROUND OF THE INVENTION

1. Field of the Invention

The present invention relates to a take-up apparatus for winding an amorphous metal ribbon manufactured through a rapidly rotating quench roll.

2. Prior Art

A method for manufacturing an amorphous metal ribbon includes rapid quenching solidification of molten amorphous material which is facilitated by the heat removing effect of a quench roll after ejecting the molten metal onto the outer circumferential surface of the quench roll which is rotating at a high speed. Since an amorphous metal ribbon can be manufactured at high rates by this method, a high-performance take-up apparatus is required for winding the ribbon, which is manufactured as mentioned above, at a high speed.

Various take-up apparatus have been provided for an amorphous metal ribbon which transport a ribbon within a guide tube by means of a gas blowing means, a shifting magnetic field or a metal conveyer belt and then wind the ribbon up (see Japanese Laid Open Patent Applications No. 1981-99054 and No. 1986-82953). However, there are a number of disadvantages associated therewith. For example, it is impossible to exactly coincide the circumferential speed of the quench roll with that of a take-up drum. Lack of uniformity or breakage of a ribbon is caused when the circumferential speed of the quench roll is lower than that of the take-up drum. It is impossible to wind the ribbon in good order by the take-up drum when the former is higher than the latter and dancing of the ribbon might occur when the ribbon is transported by gas blowing means.

Japanese Laid Open Patent Application No. 1985-246613 discloses a construction where an amorphous metal ribbon manufactured by means of a quench roll is first transported into a storage device. However, since the winding and stopping of the ribbon is repeated intermittently so that the ribbon can be taken up directly by a take-up frame comprising a plurality of steel cores, the storage device becomes very large in size. Further, since the ribbon is adapted to be brought into the storage device by a gas blowing means, disadvantageous ribbon dancing as well as ribbon entanglements are apt to occur.

A grasp and cut technology in which the fore part of the ribbon is grasped and the leading end portion beyond the grasped portion of the fore part is cut off before carrying out the ribbon winding is disclosed in Japanese Laid Open Patent Application No. 1978-24961. That is in order to grasp and cut the ribbon, a take-up drum is provided on its take-up surface with an axial recess and a gripping lever is pivotably mounted on its side portion so as to project and fit in the recess. However, the complicated construction is a disadvantage. Additionally as a means for compensating for the differences in the circumferential speeds of a quench roll and of the take-up drum, a vertically movable roller is provided therebetween. However since the vertical movement of the roller is accompanied by an inertia force, the ribbon is subjected to an excessive tension force due to the inertia of the roller when a quantity of the stored ribbon is changed over from an increasing trend to a decreasing trend and to the contrary, the ribbon is not subjected to tension when a quantity of the stored ribbon is changed over from a decreasing trend to an increasing trend. In the latter case, since there is a problem similar to that caused by the disagreement in the circumferential speeds of the quench roll and of the take-up drum, it is impossible to wind the ribbon under a constant tension.

SUMMARY OF THE INVENTION

The present invention is directed to solving the above-mentioned problems. The present invention provides a take-up apparatus for an amorphous metal ribbon comprising, in combination, a first guide means providing a passage for an amorphous metal ribbon, a storage means connected to said first guide means, a take-up drum connected to said storage means through a second guide means, and a gas suction means connected to said take-up drum through a third guide means.

The apparatus for manufacturing the amorphous metal ribbon comprises a crucible equipped at its lower end with a nozzle for accommodating a molten metal therewithin and a rapidly rotating quench roll disposed below the nozzle whereby the amorphous metal ribbon is manufactured by rapidly quenching the molten metal on the quench roll. The first guide means comprises a tube bearing a large diameter end portion adjacent the quench roll for receiving the ribbon.

The gas within the first, second and third guide means is sucked by a first gas suction means at a higher speed than the ribbon manufacturing speed. The storage means comprises a channel portion providing a passage for the ribbon, a storage container disposed on one side of the running ribbon in the thickness direction thereof and equipped with an opening and closing mechanism at its bottom on the channel portion side, a second gas suction means disposed on the opposite side of the storage container relative to the opening and closing mechanism and a gas blowing means for supplying a gas under pressure to the channel portion. The channel portion includes side walls defining its opposite sides in the width direction of the ribbon and a bottom wall facing the underside of the ribbon. In the bottom of the channel portion, there are provided a plurality of apertures connected to the gas blowing means.

The opening and closing mechanism comprises a shutter plate and a piston and cylinder assembly for actuating the shutter plate. The storage container is provided at its bottom with at least one ribbon guide roller, which may be made of a light metal or of a resin and provided at its turning portion with a ball bearing. The storage container is provided with an air reservoir having an air blowout outlet formed at the bottom. The storage container is configured as a rectangular box having a lower portion with the walls thereof tapering inwardly and upwardly and intermediate and upper portions with a constant width extending upwardly therefrom. The inside width $W_b$ of the constant width portion is defined relative to the ribbon width $W_r$ by the equation of $W_b = W_r + (1\text{–}5\ \text{mm})$. The storage means is provided with a detector for detecting the quantity of the stored ribbon therewithin so as to control the revolution numbers of the take-up drum according to the quantity of the stored ribbon. The take-up drum comprises a one-sided flange type drum having a through hole formed in its cylindrical peripheral surface and the other side open. The second guide means is formed telescopically so as to be inserted into and pulled out of the through hole and one end of the third guide means is so located inside the drum as to be opposed to and connectable to the end of the second guide means. The second guide means comprises two tubes fitted in each other like a telescope. The second guide means is arranged so as to extend in a direction spaced above or below the center of the take-up drum. The third guide means comprises an L-shaped tube having one end located inside the take-up drum. The take-up drum is adapted to be driven by means of a motor through a clutch and has the peripheral surface partially covered with an adhesive.

Since the first gas suction means is disposed at the foremost position in the advancing direction of the ribbon, the dancing of the ribbon can be prevented. Since the storage means is interposed between the ribbon manufacturing device and take-up drum, the ribbon can be prevented from being non-uniform, broken or wound in bad order on the take-up drum.

Since the ribbon is adapted to be brought into the storage means by a gas blowing means, the ribbon can be surely stored and it is possible to neglect the inertia effect associated with the increase and decrease of the quantity of the stored ribbon. Therefore, a tension force effect caused by the take-up drum is prevented from being transmitted to the manufacturing device and the ribbon supplied to the take-up drum is always subjected to a certain back-tension so that the take-up drum can wind up the ribbon in good order.

Furthermore, since the second guide means is adapted to extend telescopically through the hole in the drum so as to be connected to the third guide means, it is possible to grasp the ribbon in a simple manner. Since the take-up drum is light in weight due to its one-sided flange construction, it can be driven so as to reach a predetermined circumferential speed quickly. Further, it is possible to tear off the leading end portion of the ribbon by simply turning the take-up drum. The torn off portion thereof is prevented from being entangled in or around the peripheral surface of the take-up drum.

Since the quantity of the stored ribbon is always maintained in a certain range an avoidance of a related interference between the quench roll and the take-up drum as well as an application of the back tension to the take-up drum can be surely accomplished.

The present invention will now be described in greater detail with reference to the accompanying drawings.

DESCRIPTION OF THE PREFERRED EMBODIMENTS

Figure 1:
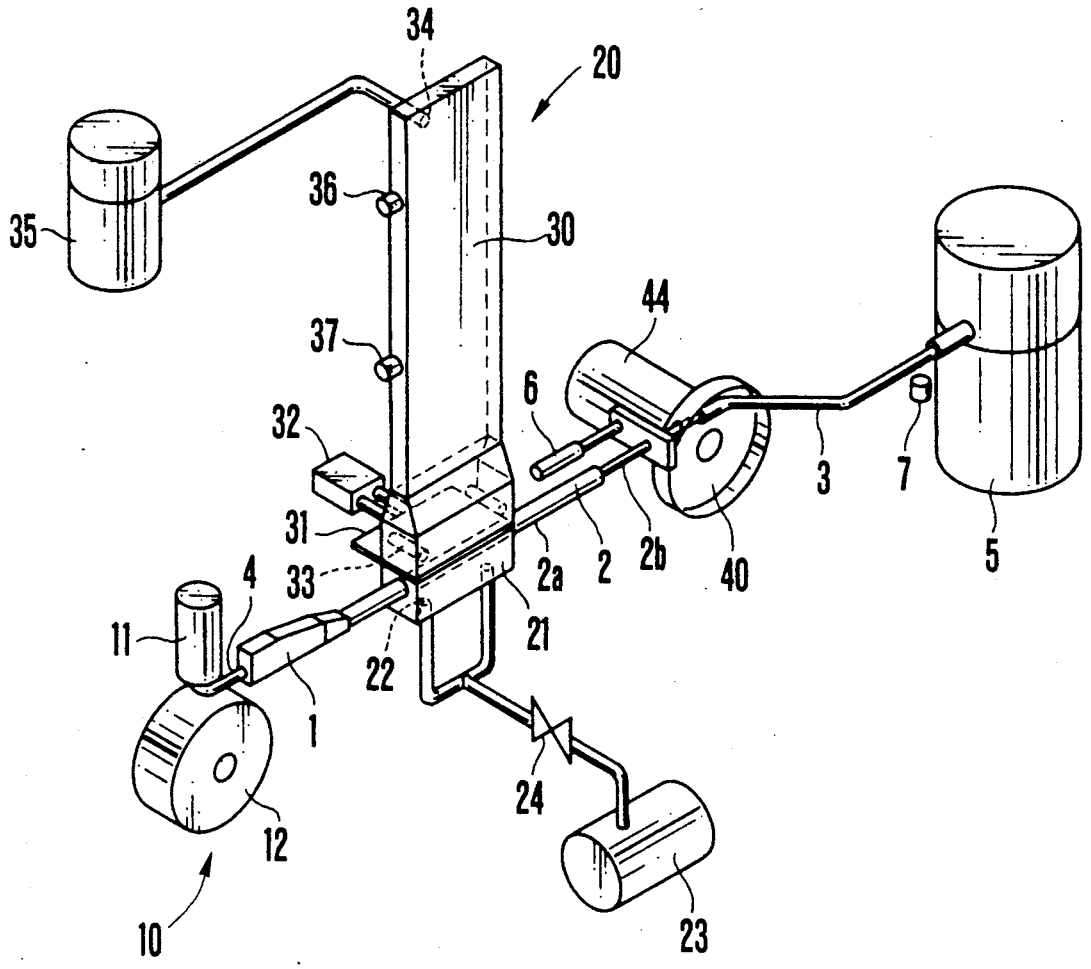
FIG. 1 is a perspective view showing one embodiment of a take-up apparatus according to the present invention.

One embodiment of the present invention will be explained with reference to the accompanying drawings hereinafter. FIG. 1 is a perspective view showing one embodiment of the present invention, in which a manufacturing device 10 for an amorphous metal ribbon 4 comprises a crucible 11 equipped at its lower end with a nozzle, a molten metal accommodated within the crucible 11 and a quench roll 12 disposed below the nozzle. The molten metal is adapted to be quenched rapidly by the quench roll 12 so as to produce the amorphous metal ribbon 4, which is then adapted to be driven so as to fly out at a high speed in a direction tangent to the quench roll 12.

Thereafter, the ribbon 4 is advanced through a first guide tube 1, a storage device 20, a second guide tube 2, a take-up drum 40 and a third guide tube 3 in order and brought to a gas suction device 5. The advancing direction of the ribbon is defined as the forward direction and the opposite direction thereto is defined as the backward direction for reference purposes in the following explanation. The first guide tube 1 has a back end enlarged in diameter like a trumpet so as to enable the tube to catch the ribbon 4 flying out of the quench roll 12 as well as to suck air therein without producing a turbulent flow, which air is adapted to be sucked by the gas suction device 5. The gas flow within the guide tubes is produced by the gas suction device 5 at a higher speed than the ribbon manufacturing speed.

Since this embodiment is constituted as mentioned above with the gas suction device 5, which acts as a transportation means for the ribbon 4, disposed at the foremost position in the advancing direction of the ribbon 4, it is possible to prevent the dancing of the ribbon 4 which is apt to be caused if the gas blowing means is located in the intermediate portion of the advancing route for the ribbon 4. Since a storage device 20 is interposed between the ribbon manufacturing device 10 and the take-up drum 40, it is possible to prevent lack of uniformity of the ribbon 4, a breakage thereof or a ribbon winding in bad order by the take-up drum 40 which could occur in the absence of a storage device 20 therebetween.

The storage device 20 according to this embodiment is provided with a channel portion 21 having side walls on opposite sides of the ribbon 4 in the width direction of the ribbon 4 and a bottom wall for the passage for the ribbon 4. The channel portion 21 is connected at its back end to the front end of the first guide tube 1 and is connected at its front end to the back end of the second guide tube 2. In the bottom of the channel portion 21, there are provided a plurality of compressed air blowout outlets 22 which are connected to an air compressor 23 through a solenoid valve 24. There is also provided a storage container 30 above the channel portion21.

The storage container 30 is configured as a rectangular box having a rectangular cross-section. The storage container 30 is provided at its bottom with a shutter plate 31 which is adapted to be reciprocatively actuated from the side portion thereof by means of a piston and cylinder assembly 32 so as to open and close the passage between the channel portion 21 and the storage container 30. The storage container 30 is provided at the front and back ends thereof in the ribbon advancing direction with guide rollers 33 which serve to guide the ribbon 4. The storage container comprises a lower portion with upwardly and inwardly tapering walls and intermediate and upper portions extending upwardly therefrom with a constant width. The inside width $W_b$ of the constant width portion is wider than the width $W_r$ of the ribbon 4 and preferably is defined by the equation of $W_b = W_r + (1\text{-}5\ \text{mm})$. In the top portion of the storage container 30, there is provided an exhaust port 34 connected to a gas sucker 35. And in the upper and the lower portions of the storage container 30, there are provided detectors 36, 37 for the ribbon 4 stored therewithin respectively. The detectors 36. 37, may be high-frequency proximity sensors or photoelectric sensor making use of infrared rays or visible rays and the like.

In the storage device 20 as constituted above, the shutter plate 31 and the solenoid valve 24 are kept closed when the ribbon 4 is not intended to be stored therein. When the ribbon 4 is intended to be stored by means of the storage device 20, the shutter plate 31 is opened, the air compressor 23 is operated, the solenoid valve 24 is opened and the gas sucker 35 is operated. Thereupon the ribbon 4 is drawn upwardly by means of the gas sucker 35 so as to be stored within the storage container 30.

At that time, the ribbon 4 can be stored within the storage container 30 because the ribbon 4 is brought into the storage container 30 by the operation of the air compressor 23, and the ribbon 4 can be stored smoothly therewithin because in this embodiment, the guide rollers 33 are provided in the bottom of the storage container 30. Since the storage container 30 stores the ribbon 4 by means of the gas flow it is possible to neglect the inertia effect associated with the increase and decrease of the quantity of the stored ribbon. Therefore, the tension effect exerted from the side of the take-up drum 40 is prevented from being transmitted to the side of the manufacturing device 10 and the ribbon 4 supplied to the take-up drum 40 is always subjected to a certain back tension, namely to a tension force directed oppositely to the ribbon advancing direction so as to enable the winding of the ribbon 4 in good order by the take-up drum 40.

Figure 2:
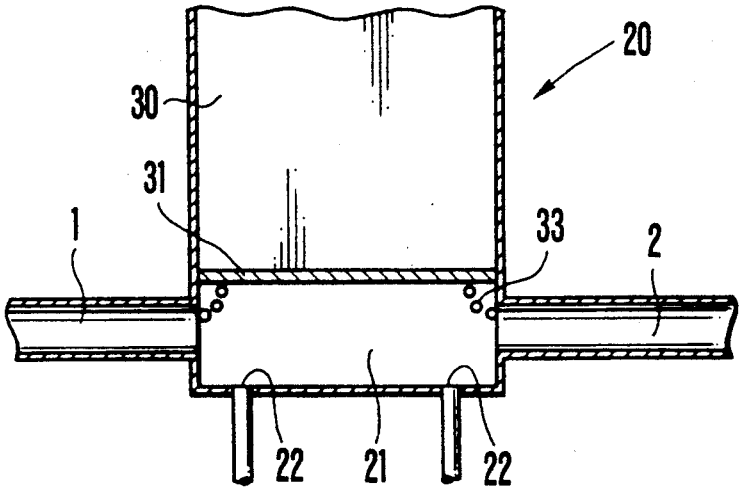
FIGS. 2–4 are vertical sectional views showing principal parts of different examples of a storage device respectively.
Figure 3:
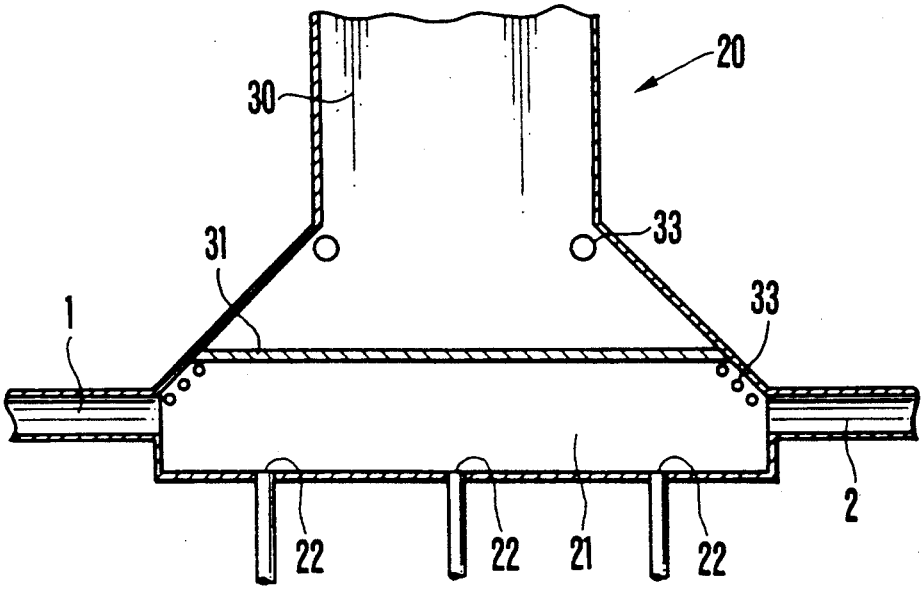
Figure 4:
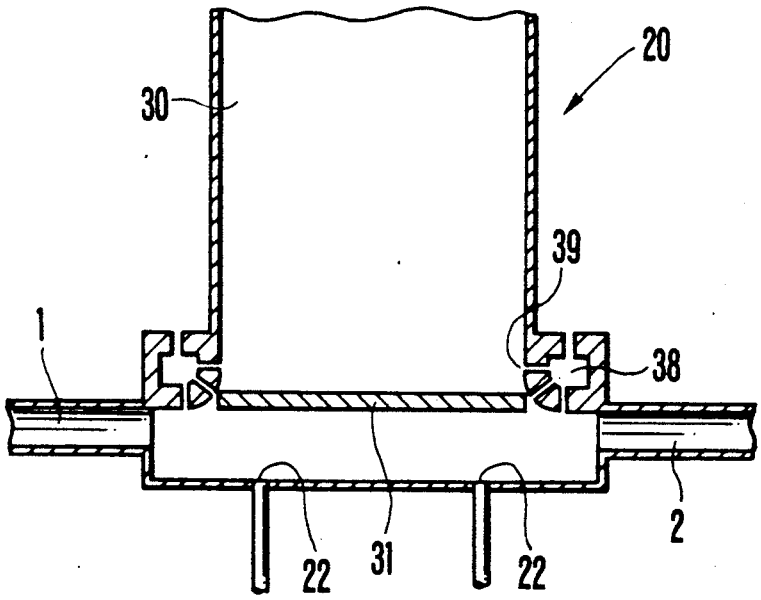

As shown in FIG. 2, plural sets of guide rollers 33 may be provided for the respective front and back corners of the storage container. In this case, since the inertia moment for each roller is small, each roller 33 can be rotated smoothly so as to decrease the resistance against the running of the ribbon 4. As shown in FIG. 3, since the corners of the lower portion of the storage container 30 are angled at an obtuse angle and provided with plural sets of guide rollers 33 respectively, the curvature of the ribbon 4 is small at each corner so as to decrease the resistance produced by contact with guide rollers 33 against the running of the ribbon 4. Preferably, each guide roller 33 is made of light metal or resin and is provided with ball bearings and the like so as to decrease turning resistance. Further, as shown in FIG. 4, since each corner of the lower portion of the storage container 30 is provided with an air reservoir 38 having air blowout outlets 39 through which compressed air is blown out instead of the guide rollers 33, the ribbon 4 can be movably supported in a noncontact state by the air blown out through the outlets 39. By the adoption of a construction including guide rollers or compressed air as mentioned above, the resistance against the running of the ribbon 4 is decreased so that the ribbon 4 can be prevented from being broken or damaged in the lower portion of the storage container 30.

The bottom of the channel 21 may be provided with the compressed air blowout outlets 22 of not less than three in number as shown in FIG. 3. The air blowing out direction is not always required to intersect perpendicularly with the advancing direction of the ribbon 4. The blowout outlets may be directed with a forward slant on the back side of the channel portion 21 and with a backward slant on the front side thereof. Further, compressed air blowout outlet 22 may be formed along the whole bottom of the channel portion 21 so as to provide a uniform flow of air.

In this embodiment, the ribbon 4 is adapted to run through the channel portion 21 in a horizontal state and the storage container 30 is disposed above the channel portion 21. However, the storage container 30 may be disposed on the opposed side, namely below the channel portion 21.

The second guide tube 2, the take-up drum 40 and the third guide tube 3 according to this embodiment will be explained hereinafter. Firstly, the second guide tube 2 comprises two guide tubes 2*a*, 2*b* fitted in each other so as to extend telescopically. The back guide tube 2*a* is fixedly secured and the fore guide tube 2*b* is adapted to be slid by the piston and cylinder assembly 6 relative to the back guide tube 2*a*. The second guide tube 2 may be composed of a bellows.

Figure 5:
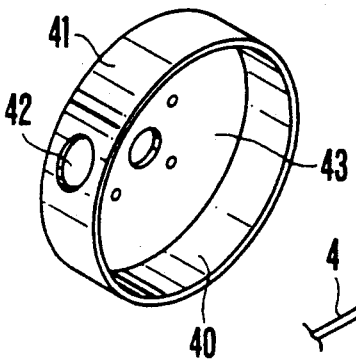
FIG. 5 is a perspective view showing a take-up drum.
Figure 6:
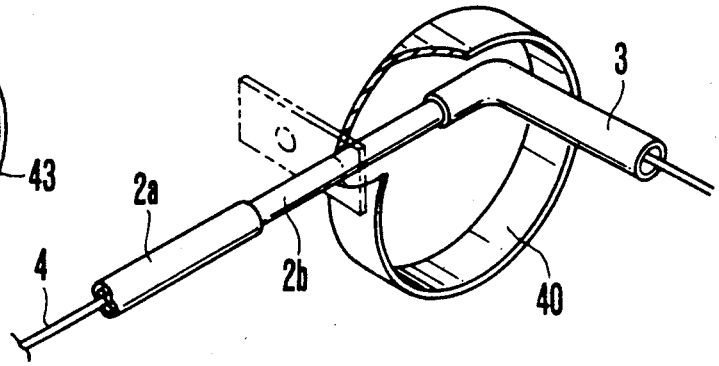
FIGS. 6–8 are perspective views showing the conditions of the take-up drum before the commencement of winding, just after the commencement of winding and at a progressed state of winding respectively.

As shown in FIG. 5, the take-up drum 40 is cylindrical and provided at its peripheral surface 41 with a through hole 42 having a larger diameter than the outer diameter of the second guide tube 2. One side wall of the take-up drum 40 is formed as a flange 43 for use in connection to a drive mechanism 44. The other side thereof is open. The third guide tube 3 is inserted into the interior space of the take-up drum 40 through the open side with one end thereof being opposed to the through hole 42 inside the drum 40. Accordingly as shown in FIG. 6, the third guide tube 3 is adapted to be connected with one end of the second guide tube 2 after the second guide tube 2 is extended through the through hole 42. And in order to detect the passing of the ribbon 4 through the third guide tube 3, a detector 7 is disposed near the third guide tube 3. Otherwise, the detector 7 may be disposed for example, near the leading end of the second guide tube 2. The detector 7 may be of the same type as detectors 36, 37 mounted on the storage container 30.

Figure 7:
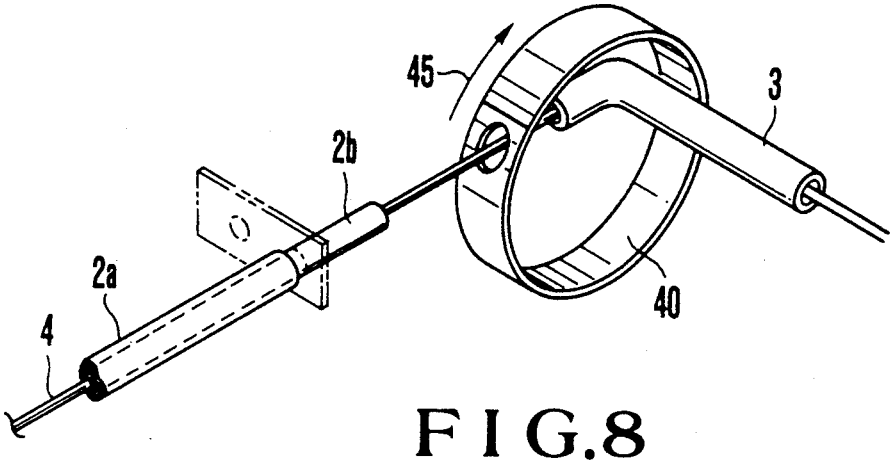

Since the take-up drum 40 and the second and third guide tubes 2. 3 according to this embodiment are constituted as mentioned above, when the ribbon detector 7 disposed near the third guide tube 3 detects the passing of the ribbon 4, the second guide tube 2 is adapted to be pulled out of the through hole 42 after the lapse of a certain time as shown in FIG. 7. In this embodiment, the cylinder 6 is adapted to be actuated after the lapse of 0.1-1 second after the detection of the ribbon 4. Then the take-up drum 40 is rotated by the drive mechanism 44 so that the ribbon 4 can be wound around the take-up drum 40. Thereupon, since the portion of the ribbon 4 having already passed through the through hole 42 at the time of the rotation of the take-up drum 40 is adapted to be torn off at the position of the through hole 42 or the end of the third guide tube 3, the torn off fore portion thereof, namely an inferior portion produced at the beginning of the manufacturing is prevented from being entangled in or around the peripheral surface of the take-up drum 40.

For driving the take-up drum 40 immediately at a high speed, the drive mechanism 44 according to this embodiment is provided with a motor and a clutch. The take-up drum 40 is adapted to be driven at a high speed after the lapse of 0.01–1 second after the actuation of the cylinder 6 by the actuation of the clutch which serves to transmit the high speed rotation of the motor which was previously operated to the drum 40. Thereupon, since the take-up drum 40 is light in weight due to its one-sided flange-type construction as noted above, it takes only a short time to reach a predetermined circumferential speed suitable to the ribbon producing speed. For example it takes only 0.05–0.2 seconds to reach a rated rotation speed in this embodiment. Thereupon, the storage device 20 serves to store the ribbon 4 which has been oversupplied until the circumferential speed of the take-up drum 40 substantially meets with the ribbon producing speed. It is preferable that the peripheral surface of the take-up drum 40 is partially or entirely covered with an adhesive coating.

Figure 8:
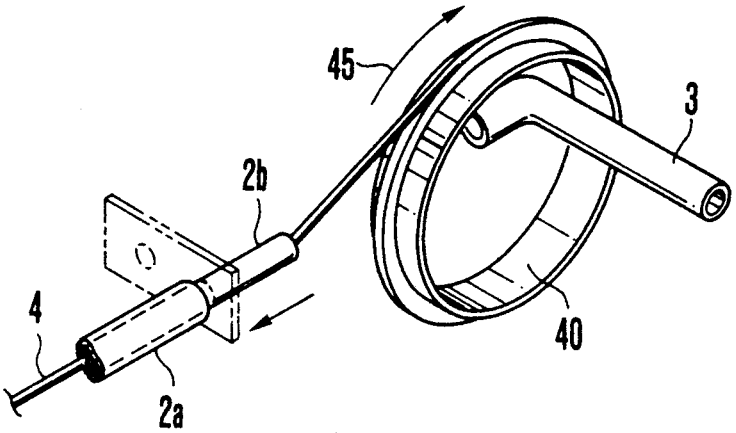

In order to start the winding smoothly, it is preferable that the second guide tube 2 is arranged so as to extend not toward the center of the take-up drum 40 but toward an upper or a lower point offset from the center thereof and the rotational direction of the take-up drum 40 is selected so that the ribbon 4 doesn't form an acute angle. In FIG. 7, since the second guide tube 2 is so arranged as to extend toward an upper point offset from the center of the take-up drum 40, the take-up drum 40 is rotated in a direction shown by the arrow 45. Since the outer diameter of the ribbon 4 wound around the take-up drum 40 is increased gradually with its winding, it is preferable to shift the fore end of the second guide tube 2 backward as the winding is advanced as shown in FIG. 8.

Figure 9:
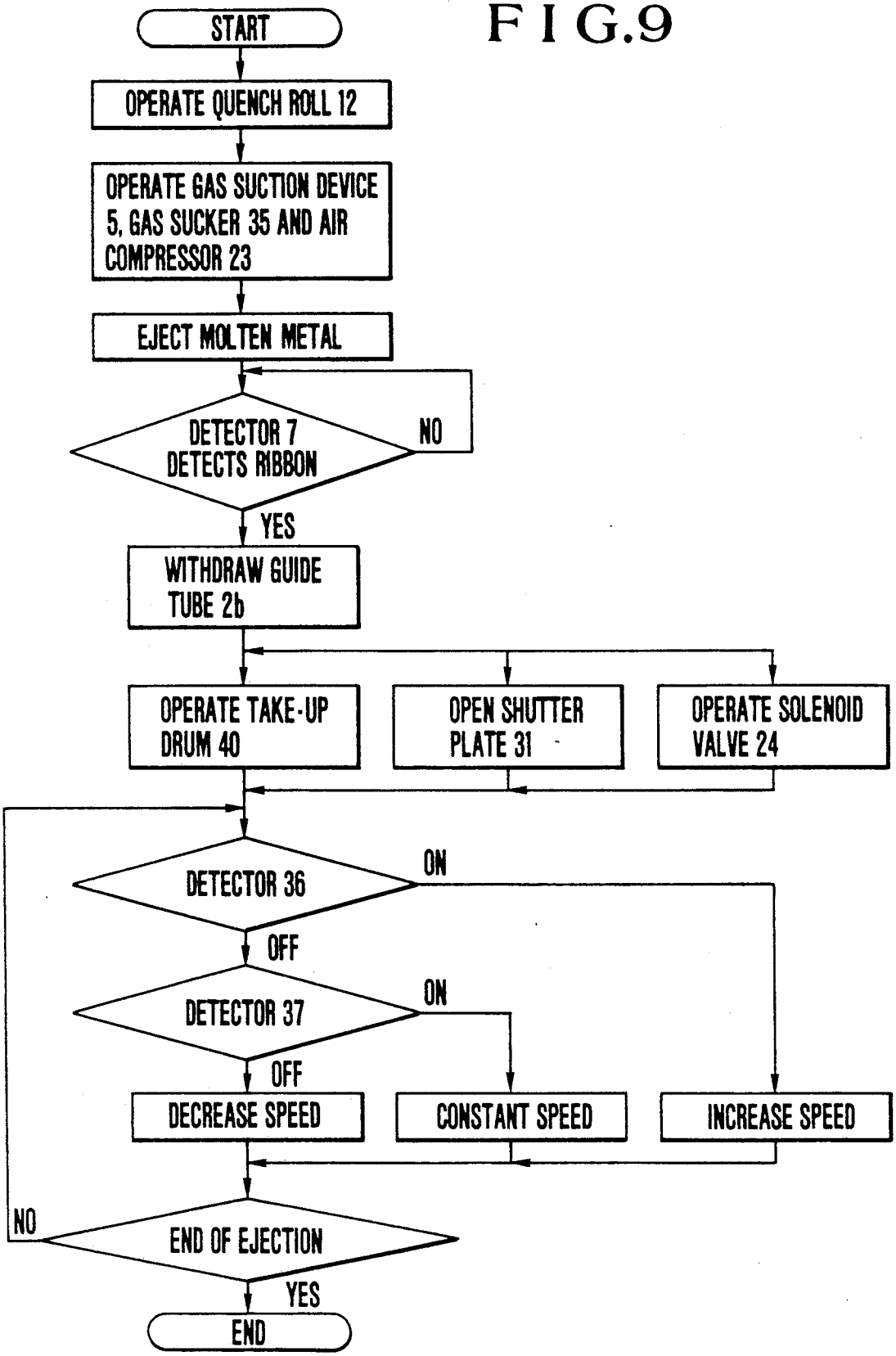
FIG. 9 is a flow chart showing one example of a control method for the take-up apparatus according to the present invention.

The control mechanism for the whole take-up apparatus according to this embodiment will be explained with reference to FIG. 9. First of all the shutter plate 31 of the storage container 30 and the solenoid valve 24 are closed, the second guide tube 2 is passed through the hole 42 and is connected to the third guide tube 3, and the operations of the quench roll 12 the gas suction device 5 connected to the leading end of the third guide tube 3, the gas sucker 35 connected to the storage container 30 and the air compressor 23 are started. When the molten metal within the crucible 11 is ejected onto the quench roll 12, the ribbon 4 is produced by means of the rapid quenching solidification accompanied with a production of an amorphous material and sucked by the gas suction device 5 so as to pass through the first guide tube 1, the channel portion 21 of the storage device 20, the second guide tube 2 and the third guide tube 3.

When the detector 7 detects the passing of the ribbon 4, the fore end of the second guide tube 2 is pulled out of the hole 42 and the take-up drum 40 is operated so as to start the winding of the ribbon 4. At substantially the same time, the shutter plate 31 of the storage container 30 is retracted so as to be opened and the solenoid valve 24 is opened. In this embodiment, the shutter plate 31 and the solenoid valve 24 are opened simultaneously with or before the starting of the winding. As a result, the ribbon 4 is inducted into the storage container 30 by the gas flow from the lower side to the upper side.

Thereupon, the revolution of the take-up drum 40 is controlled in such a way that a speed increase command is transmitted to the drive mechanism 44 when the upper detector 36 of the storage container 30 detects the existence of the ribbon 4, a speed decrease command is transmitted to the drive mechanism 44 when the lower detector 37 thereof doesn't detect the existence of the ribbon 4 and otherwise a constant speed is maintained. As a result, a quantity of stored ribbon 4 is always maintained between the two positions of the upper detector 36 and the lower detector 37 to compensate for errors caused by a delay of response time.

Having thus described the preferred embodiments of the invention, it should be understood that numerous structural modifications and adaptations may be resorted without departing from the spirit of the invention.

What is claimed is:

1. A take-up apparatus for an amorphous metal ribbon comprising, in combination:

a first, second and third guide means providing a passage for an amorphous metal ribbon;

a storage means connected between said first and second guide means;

a take-up drum connected to said storage means through a second guide means; and first gas suction means connected to said take-up drum through a third guide means to provide a flow of gas to draw said ribbon through said guide means, said storage means and said take-up drum said storage means comprising a channel portion providing a passage for the ribbon, a storage container mounted on said channel portion and provided with an opening and closing mechanism adjacent the channel portion, a second gas suction means disposed on a side of the storage container opposite to the opening and closing mechanism and a gas blowing means for introducing a gas under pressure to the channel portion for directing said ribbon into said storage container.

2. A take-up apparatus as recited in claim 1, wherein said channel portion includes side walls and a bottom wall.

3. A take-up apparatus as recited in claim 2, wherein said bottom wall of the channel portion is provided with a plurality of inlets connected to said gas blowing means.

4. A take-up apparatus as recited in claim 1, wherein said opening and closing mechanism comprises a shutter plate and a piston cylinder assembly for actuating the shutter plate.

5. A take-up apparatus as recited in claim 1, wherein said storage container is further provided at its bottom with at least one ribbon guide roller.

6. A take-up apparatus as recited in claim 5, wherein said roller is made of a light metal or of a resin.

7. A take-up apparatus as recited in claim 6, wherein said roller is provided with a ball bearing.

8. A take-up apparatus as recited in claim 1, wherein said storage container is further provided with an air reservoir having air outlets formed adjacent said opening and closing mechanism to provide air bearings for said ribbon.

9. A take-up apparatus as recited in claim 1, wherein said storage container is configured as a rectangular box having a lower portion with inwardly and upwardly tapering sides and intermediate and upper portions with a constant width extending upwardly from said lower portion.

10. A take-up apparatus as recited in claim 9, wherein the inside width $W_b$ of said constant width portion is defined relative to, the ribbon width $W_r$ by the equation of $W_b = W_r + (1 \text{to } 5 \text{ mm})$.

11. A take-up apparatus as recited in claim 1, wherein said storage means is provided with a detector for detecting a quantity of stored ribbon therewithin so as to control the speed of rotation of the take-up drum according to the quantity of the stored ribbon.

12. A take-up apparatus as recited in claim 1, wherein said take-up drum comprises a one-sided flange-type drum having a through hole formed in its cylindrical peripheral surface and one side open, said second guide means is formed telescopically for insertion into and out of said through hole, and one end of the third guide means is so located inside the drum as to be opposed to and connectable with the end of said second guide means.

13. A take-up apparatus as recited in claim 12, wherein said second guide means comprises two tubes fitted one in the other like a telescope.

14. A take-up apparatus as recited in claim 12, wherein said second guide means is arranged so as to extend in a direction spaced above or below a center of said take-up drum.

15. A take-up apparatus as recited in claim 12, wherein said third guide means comprises an L-shaped tube having one end located inside the take-up drum.

16. A take-up apparatus as recited in claim 1, wherein said take-up drum is adapted to be driven by means of a motor and a clutch assembly.

17. A take-up apparatus as recited in claim 1, wherein said take-up drum has the peripheral surface partially covered with an adhesive.

* * * * *